US011821294B2

(12) United States Patent
Azom et al.

(10) Patent No.: US 11,821,294 B2
(45) Date of Patent: Nov. 21, 2023

(54) METHODS FOR RECOVERING SOLVENT AND PRODUCING HYDROCARBONS FROM SUBTERRANEAN RESERVOIRS

(71) Applicant: Cenovus Energy Inc., Calgary (CA)

(72) Inventors: Prince Azom, Calgary (CA); Amos Ben-Zvi, Calgary (CA); Simon D. Gittins, Calgary (CA); Ishan Deep Singh Kochhar, Calgary (CA); Ryan Miller, Calgary (CA)

(73) Assignee: Cenovus Energy Inc., Calgary (CA)

( * ) Notice: Subject to any disclaimer, the term of this patent is extended or adjusted under 35 U.S.C. 154(b) by 0 days.

(21) Appl. No.: 17/352,151

(22) Filed: Jun. 18, 2021

(65) Prior Publication Data

US 2021/0396111 A1 Dec. 23, 2021

Related U.S. Application Data

(60) Provisional application No. 63/040,960, filed on Jun. 18, 2020.

(51) Int. Cl.
*E21B 43/24* (2006.01)
*E21B 43/241* (2006.01)

(52) U.S. Cl.
CPC ..... *E21B 43/2408* (2013.01); *E21B 43/241* (2013.01)

(58) Field of Classification Search
CPC ..... E21B 43/2408; E21B 43/241; E21B 43/2406; E21B 453/2405; E21B 43/24; E21B 43/16; E21B 43/164; E21B 43/166; E21B 43/168
See application file for complete search history.

(56) References Cited

U.S. PATENT DOCUMENTS

| | | | | |
|---|---|---|---|---|
| 4,004,636 | A * | 1/1977 | Brown | E21B 43/24 166/401 |
| 10,190,400 | B2 * | 1/2019 | Alvestad | C09K 8/592 |
| 2013/0025858 | A1 * | 1/2013 | Hoier | E21B 43/24 166/268 |
| 2014/0096960 | A1 * | 4/2014 | Kerr | E21B 43/168 166/272.3 |
| 2019/0032460 | A1 * | 1/2019 | Khaledi | E21B 43/24 |

FOREIGN PATENT DOCUMENTS

| | | | | |
|---|---|---|---|---|
| CA | 2698898 | A1 | 7/2011 | |
| CA | 2757125 | A1 | 2/2013 | |
| CA | 2831928 | A1 | 5/2014 | |
| CA | 2884990 | A1 | 9/2015 | |
| CA | 2886934 | A1 | 9/2015 | |
| WO | WO-2015000066 | A1 * | 1/2015 | E21B 43/2406 |

* cited by examiner

*Primary Examiner* — Angela M DiTrani Leff
(74) *Attorney, Agent, or Firm* — GORDON & JACOBSON, P.C.

(57) ABSTRACT

Methods are provided for producing hydrocarbons and recovering solvent from a subterranean reservoir that is penetrated by an injection well and a production well, in which a production phase involves injecting solvent (and optionally steam) to mobilize viscous hydrocarbons and a solvent-recovery phase involves non-condensable gas injection. The production phase and the solvent-recovery phase are each defined by an injection profile. The solvent-recovery-phase injection profile is selected: (i) based on the production-phase injection profile, and (ii) to ensure the pressure/temperature conditions in proximity to the production well favor gas-phase solvent recovery.

18 Claims, 8 Drawing Sheets

METHODS FOR RECOVERING SOLVENT AND PRODUCING HYDROCARBONS FROM SUBTERRANEAN RESERVOIRS

TECHNICAL FIELD

The present disclosure generally relates to in-situ hydrocarbon production. In particular, the present disclosure relates to methods for hydrocarbon production that involve injecting and recovering solvent.

BACKGROUND

Viscous hydrocarbons can be extracted from some subterranean reservoirs using in-situ production processes. Some in-situ production processes are thermal processes wherein heat energy is introduced to a reservoir to lower the viscosity of hydrocarbons in situ such that they can be recovered from a production well. In some thermal processes, heat energy is introduced by injecting a heated injection fluid into the reservoir by way of an injection well. Steam-assisted gravity drainage (SAGD) is a representative thermal-recovery process that uses steam to mobilize hydrocarbons in situ.

Some thermal recovery processes employ injection fluids that include solvent, optionally in combination with steam. Solvent-aided processes (SAP) are one such category. In the context of the present disclosure, SAP injection fluids comprise less than about 50% solvent and greater than about 50% steam on a mass basis. Solvent-driven processes (SDP) are another such category. In the context of the present disclosure, SDP injection fluids comprise greater than about 50% solvent and less than about 50% steam on a mass basis. SAP and/or SDP processes are typically employed as one phase in a broader production profile. For example, a well may be transitioned through: (i) a start-up phase during which hydraulic communication is established between an injection well and a production well; (ii) a SAGD phase during which a production chamber expands primarily in a vertical direction from the injection well and mobilized hydrocarbons are recovered from the production well along with condensed steam; (iii) an SAP and/or SDP phase during which injected solvent facilitates further chamber growth and hydrocarbon mobilization such that solvent and mobilized hydrocarbons are produced via the production well; and (iv) a blowdown phase during which non-condensable gas is injected to recover residual hydrocarbons and solvent that would otherwise remain stranded.

For many SAP- and/or SDP-based recovery processes, the blowdown phase is of critical importance, because solvents are generally more valuable than produced hydrocarbons. However, successfully executing solvent and hydrocarbon recovery during blowdown of an SAP and/or SDP well is a difficult task due, at least in part, to the large number of variables at play. Conventional approaches do little to account for the nuances and complexities associated with blowing down wells produced using particular SAP and/or SDP protocols, and there is an unmet need for methods for hydrocarbon and solvent recovery that are more prescriptive and effective in this respect.

SUMMARY

The present disclosure asserts that efficient solvent-recovery processes (i.e. solvent blowdown) can be realized for a wide variety of SAP- and/or SDP-based production processes provided that the requisite blowdown protocols are select in view of the particulars of the injection profile used to facilitate hydrocarbon production. In the context of the present disclosure, the term "production-phase injection profile" is used to define the temperature, pressure, injection rate, and/or composition of the injection fluid(s) used to prioritize hydrocarbon production, while the term "solvent-recovery-phase injection profile" is used to define the temperature, pressure, injection rate, and/or composition of the injection fluid(s) used to prioritize solvent recovery. Briefly stated, the present disclosure provides a framework for selecting a solvent-recovery-phase injection profile in view of a production-phase injection profile for a wide variety of SAP- and/or SDP-based processes.

The present disclosure is based on extensive field trials and state-of-the-art simulation work, which indicate that: (i) prioritizing solvent recovery in the gas-phase is key to effective SAP and/or SDP well blowdown; and (ii) the parameters required to achieve efficient gas-phase solvent recovery are highly sensitive to the production-phase injection profile. For example, as set out in examples herein, seemingly small differences such as whether casing-gas reinjection is employed during SDP lead to different parameters for achieving efficient solvent-recovery during blowdown.

Accordingly, the methods of the present disclosure define the phase (liquid vs. gas) of various solvent-containing fluids under reservoir conditions with reference to the vapourization-curves of their respective phase-diagrams and particular parameters for solvent-recovery-phase injection fluids and production-phase injection fluids.

Select embodiments of the present disclosure relate to a method of producing hydrocarbons and recovering solvent from a subterranean reservoir. the method comprises orchestrating a production phase by injecting a production-phase injection fluid into the reservoir and modulating production of hydrocarbon-containing fluids. The injecting of the production-phase injection fluid is defined at least in part by a production-phase injection profile comprising: (i) a production-phase injection-fluid composition that is constant or variable, (ii) a production-phase injection-fluid temperature that is constant or variable, and (iii) a production-phase injection rate that is constant or variable. The injection-fluid composition comprises a solvent that has a liquid phase, a vapour phase, and a vapourization curve that can be used to define the dominant state of the solvent under reservoir conditions. The orchestrating of the production phase yields a production-phase bottom-hole pressure-temperature condition that lies above the vapourization curve of the solvent. The method further comprises orchestrating a solvent-recovery phase by injecting a solvent-recovery-phase injection fluid into the reservoir and modulating production of solvent-containing fluids from the reservoir. The injecting of the solvent-recovery-phase injection fluid is defined at least in part by a solvent-recovery-phase injection profile comprising: (i) a solvent-recovery-phase injection-fluid composition that is constant or variable and that comprises a non-condensable gas (NCG), (ii) a solvent-recovery-phase injection-fluid temperature that is constant or variable, and (iii) a solvent-recovery-phase injection rate that is constant or variable. The solvent-recovery injection profile is selected based on the production-phase injection profile and production-well inflow parameters measured during the solvent-recovery phase to provide a solvent-recovery-phase bottom-hole pressure-temperature condition that lies below the vapourization curve of the solvent during at least part of the solvent-recovery phase.

Other aspects and features of the methods of the present disclosure will become apparent to those ordinarily skilled in the art upon review of the following description of specific embodiments.

BRIEF DESCRIPTION OF THE DRAWINGS

These and other features of the present disclosure will become more apparent in the following description in which reference is made to the appended drawings. The appended drawings illustrate one or more embodiments of the present disclosure by way of example only and are not to be construed as limiting the scope of the present disclosure.

DETAILED DESCRIPTION

While conventional SAGD processes can be operated with little to no "subcool"—injection and production protocols are executed such that the temperature near the production well is similar to the temperature near the injection well. In contrast, SAP- and/or SDP-based protocols are typically operated with significant subcool to ensure solvent exists primarily in the liquid phase in proximity to the production well. Maintaining solvent primarily in the liquid phase near the production well is generally believed to mitigate process inefficiencies such as solvent shortcutting. Accordingly, during the production-phase, the solvent content of the injection fluid impacts both injection and production protocols. At the same time, the solvent content of a production-phase injection fluid has considerable impact on reservoir temperature (higher solvent-injection concentrations correlate with lower reservoir temperatures), and this further influences both injection and production protocols. This interplay of potentially confounding variables adds considerable complexity with respect blowdown given the need for efficient solvent-recovery. The present disclosure asserts that this complexity is not intractable—efficient solvent recovery during ramp-down and/or blowdown is attainable through a tailored approach that: (i) takes into account the particulars of the injection profile used during hydrocarbon production, and (ii) prioritizes solvent recovery in the gas-phase.

Figure 1:
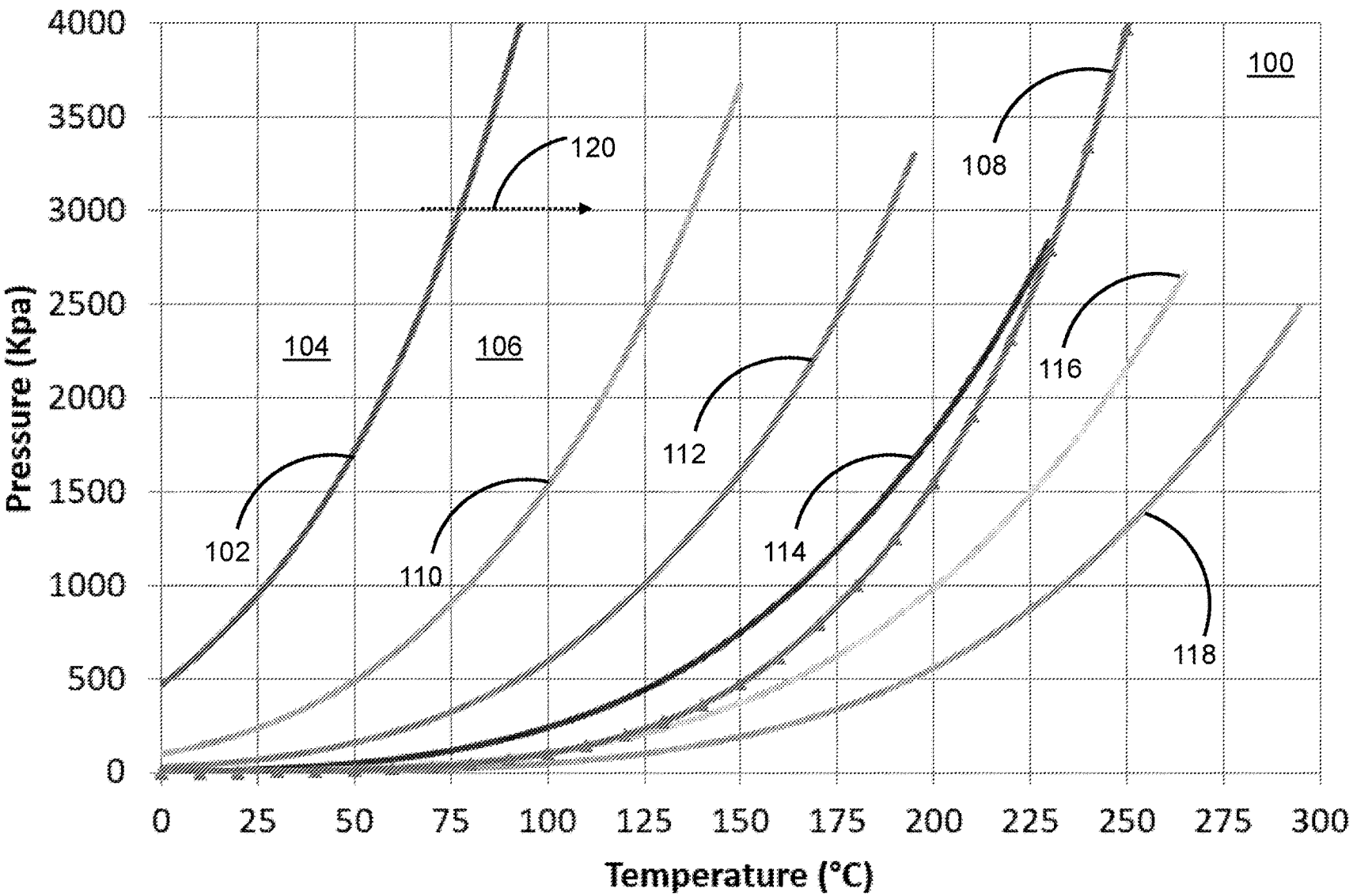
FIG. 1 shows a phase diagram with vapourization curves for water and a selection of solvents which may be employed in an embodiment of the present disclosure.

With respect to prioritizing solvent recovery in the gas phase, FIG. 1 provides context for pressure/temperature/phase relationships for a series of solvents under idealized conditions. FIG. 1 provides a phase diagram 100 that comprises a vertical pressure axis and a horizontal temperature axis. The phase diagram 100 further comprises a propane vapourization curve 102 that defines: (i) a region of reservoir temperature-pressure conditions 104 under which propane is substantially in the liquid phase, and (ii) a region of reservoir temperature/pressure conditions 106 under which propane is substantially in the vapour phase. Analogous vapourization curves for butane, pentane, hexane, heptane, and octane are indicated by reference numbers 110, 112, 114, 116, and 118, respectively. The phase diagram 100 also comprises a vapourization curve 108 for water. As a simplified example, mapping the changes to the pressure/temperature conditions measured at a production well relative to the propane vapourization curve 102 allows for a determination of whether the gas phase or the liquid phase is the dominant state for propane under the relevant conditions. In the context of the present disclosure, the "dominant state" of a solvent is defined with respect to its concentration in the gas phase and the liquid phase (in proximity to the production well). The dominant state of a solvent may correlate to a gas:liquid concentration ratio of: (i) at least about 70:30; (ii) at least about 80:20; or (iii) at least about 90:10. Those skilled in the art who have benefited from the teaching of the present disclosure will recognize that such ratios may be characterized as "distribution coefficients", "K values", or "equilibrium ratios", but that the equilibrium conditions are rarely if ever achieved under reservoir conditions. Nonetheless, mapping a particular set of bottom-hole pressure/temperature conditions onto such a phase diagram provides a means for determining the dominant state of a particular solvent. For example, steam and NCG injection during the solvent-recovery phase may provide a constant bottom-hole pressure of about 3,000 kPa (3 MPa) and may result in a change in bottom-hole temperature from less than about 75 C (i.e. a local reservoir pressure/temperature condition in region 104, where propane exists primarily in the liquid phase) to greater than about 80 C (a local reservoir pressure/temperature condition where propane exists primarily in the gas phase). This exemplary transition is indicated in FIG. 1 by dashed arrow 120.

With respect to tailoring the solvent-recovery-phase injection profile to account for the production-phase injection profile, the examples of the present disclosure set out potential solvent-recovery-phase injection profiles for blowing down a broad selection of steam/solvent compositions (for example following production-phase injection profiles comprising from 10 wt. % to 70 wt. % solvent). Moreover, the examples of the present disclosure set out potential blowdown protocols for production-phase injection profiles where, for a period of time, the injection fluid comprises solvent only (e.g. 100 wt. % propane). Further, the examples of the present disclosure set out potential blowdown protocols that account for the presence/absence of casing-gas re-injection during the production phase. Depending on the particulars of the production-phase protocols, the prescribed solvent-recovery-phase injection profiles comprise non-condensable gas (NCG) that may (or may not) be heated and may (or may not) be co-injected steam.

Select embodiments of the present disclosure relate to a method of producing hydrocarbons and recovering solvent from a subterranean reservoir. The method comprises orchestrating a production phase by injecting a production-phase injection fluid into the reservoir and modulating production of hydrocarbon-containing fluids. The injecting of the production-phase injection fluid is defined at least in part by a production-phase injection profile comprising: (i) a production-phase injection-fluid composition that is constant or variable, (ii) a production-phase injection-fluid temperature that is constant or variable, and (iii) a production-phase injection rate that is constant or variable. The injection-fluid composition comprises a solvent that has a liquid phase, a vapour phase, and a vapourization curve that can be used to define the dominant state of the solvent under reservoir conditions. The orchestrating of the production phase yields a production-phase bottom-hole pressure-temperature condition that lies above the vapourization curve of the solvent. The method further comprises orchestrating a solvent-recovery phase by injecting a solvent-recovery-phase injection fluid into the reservoir and modulating production of solvent-containing fluids from the reservoir. The injecting of the solvent-recovery-phase injection fluid is defined at least in part by a solvent-recovery-phase injection profile comprising: (i) a solvent-recovery-phase injection-fluid composition that is constant or variable and that comprises a non-condensable gas (NCG), (ii) a solvent-recovery-phase injection-fluid temperature that is constant or variable, and (iii) a solvent-recovery-phase injection rate that is constant or variable. The solvent-recovery injection profile is selected based on the production-phase injection profile and production-well inflow parameters measured during the solvent-recovery phase to provide a solvent-recovery-phase bottom-hole pressure-temperature condition that lies below the vapourization curve of the solvent during at least part of the solvent-recovery phase.

In select embodiments of the present disclosure, the production-phase injection-fluid composition comprises at least about 95 wt. % solvent, the solvent-recovery-phase injection-fluid composition comprises at least about 95 wt. % NCG, and the solvent-recovery-phase injection-fluid temperature is at least about 100 C.

In select embodiments of the present disclosure, the production-phase injection-fluid composition comprises at least about 99 wt. % solvent, the solvent-recovery-phase injection-fluid composition comprises at least about 99 wt. % NCG, and the solvent-recovery-phase injection-fluid temperature is between about 150 C and about 200 C.

In select embodiments of the present disclosure: (i) the production-phase injection-fluid composition comprises between about 50 wt. % and about 95 wt. % solvent, (ii) the solvent-recovery-phase injection-fluid composition comprises between about 0 wt. % and about 5 wt. % NCG, and (iii) the solvent-recovery-phase injection-fluid composition comprises between about 95 wt. % and about 100 wt. % steam.

In select embodiments of the present disclosure: (i) the production-phase injection-fluid composition comprises between about 50 wt. % and about 95 wt. % solvent, (ii) the solvent-recovery-phase injection-fluid composition is gradually changed over a period of up to about 24 months so that the solvent-recovery phase injection-fluid composition eventually comprises between about 80 wt. % and about 100 wt. % NCG, and (iii) the solvent-recovery-phase injection-fluid composition comprises between about 0 wt. % and about 20 wt. % steam.

In select embodiments of the present disclosure: (i) the production-phase injection-fluid composition comprises between about 3 wt. % and about 50 wt. % solvent; and (ii) the solvent-recovery-phase injection-fluid composition initially comprises between about 0 wt. % and about 5 wt. % NCG, and between about 95 wt. % and about 100 wt. % steam, with steam content decreasing non-monotonically so that after three years or less the solvent-recovery-phase injection-fluid comprises between about 90 wt. % and about 100 wt. % NCG, and between about 0 wt. % and about 10 wt. % steam.

In select embodiments of the present disclosure: (i) the production-phase injection-fluid composition comprises between about 3 wt. % and about 50 wt. % solvent, (ii) the solvent-recovery-phase injection-fluid composition is gradually changed over up to about 12 months so that the solvent-recovery phase injection-fluid composition eventually comprises between about 80 wt. % and about 100 wt. % NCG, and (iii) the solvent-recovery-phase injection-fluid composition comprises between about 0 wt. % and about 20 wt. % steam.

In select embodiments of the present disclosure, the injecting of the production-phase injection fluid comprises a casing-gas reinjection protocol.

In select embodiments of the present disclosure, the injecting of the production-phase injection fluid is free of a casing-gas reinjection protocol.

In select embodiments of the present disclosure, the orchestrating of the solvent-recovery phase is preceded by an iSOR of at least about 3 during the orchestrating of the production phase, and the production phase is an SAP production phase.

In select embodiments of the present disclosure, the orchestrating of the solvent-recovery phase is preceded by an iSOR of at least about 4 during the orchestrating of the production phase, and the production phase is an SAP production phase.

In select embodiments of the present disclosure, the orchestrating of the solvent-recovery phase is preceded by an iSOR of at least about 1 during the orchestrating of the production phase, and the production phase is an SDP production phase.

In select embodiments of the present disclosure, the orchestrating of the solvent-recovery phase is preceded by a recovery factor of at least about 50% during the orchestrating of the production phase.

In select embodiments of the present disclosure, the solvent comprises propane, butane, diluent, natural gas condensate, an alcohol, an amine, or a combination thereof. In select embodiments of the present disclosure, the solvent comprises propane.

In select embodiments of the present disclosure, the NCG comprises methane, flue gas, air, $CO_2$, $O_2$, $N_2$, or a combination thereof. In select embodiments of the present disclosure, the NCG comprises methane.

In the context of the present disclosure, the word "hydrocarbon" is generally used interchangeably with "petroleum" and/or "oil" to refer to mixtures of widely varying composition, as will be evident from the context in which the word is used. It is common practice to categorize hydrocarbon substances of high viscosity and density into two categories, "heavy oil" and "bitumen". For example, some sources define "heavy oil" as a hydrocarbon-containing mixture that has a mass density of greater than about 900 kg/m$^3$. Bitumen is sometimes described as that portion of a hydrocarbon-containing mixture that exists in the semi-solid or solid phase in natural deposits, with a mass density greater than about 1000 kg/m$^3$ and a viscosity greater than about 10,000 centipoise (cP; or 10 Pa·s) measured at original temperature in the deposit and atmospheric pressure, on a gas-free basis. Although these terms are in common use, references to heavy oil and bitumen represent categories of convenience, and there is a continuum of properties between heavy oil and bitumen. Accordingly, references to heavy oil and/or bitumen herein include the continuum of such substances, and do not imply the existence of some fixed and universally recognized boundary between the two substances. In particular, the term "heavy oil" includes within its scope all "bitumen" including hydrocarbons that are present in semi-solid or solid form.

In the context of the present disclosure, a "reservoir" or "hydrocarbon-bearing formation" is a subsurface formation containing one or more natural accumulations of moveable hydrocarbons, which are generally confined by relatively impermeable rock. An "oil sand" reservoir is generally comprised of strata of sand or sandstone containing viscous hydrocarbons, such as bitumen. Viscous petroleum, such as bitumen, may also be found in reservoirs whose solid structure consists of carbonate material rather than sand material. Such reservoirs are sometimes referred to as "bituminous carbonates".

In select embodiments of the present disclosure, the subterranean reservoir is a thin pay reservoir having a 5 m to 15 m section (into which the wells are drilled), which is hydrocarbon bearing, vertically contiguous, and without significant barriers to steam rise or hydrocarbon drainage. In general, these kinds of reservoirs may be stacked (but separated by a barrier) or have a high quality portion underlying a low quality portion, where the low quality portion contains barriers to steam rise.

In the context of the present disclosure, a solvent-recovery-phase may comprise ramp-down and/or blowdown processes. Ramp-down and/or blowdown processes may be executed after a threshold production metric is reached that signals the potential for a decline in the profitability of the well. For example, ramp-down and/or blowdown may be triggered by a particular recovery factor (such as 50% recovery of the estimated oil in place, 60% recovery of the estimated oil in place, or 70% recovery of the estimated oil in place) or by a particular steam-oil ratio (such as greater that about 3.0, about 3.5, or about 4.0).

In the context of the present disclosure, ramp-down may comprise an iterative shift from an injection fluid composition primarily comprising steam and/or solvent to an injection mixture to an injection fluid composition primarily comprising NCG over the course of weeks or months. For example, during ramp-down the injection fluid may be transitioned from a first composition of about 100 wt. % steam and/or solvent and about 0 wt. % NCG to a second compositions comprising about 0 wt. % steam and/or solvent and about 100 wt. % NCG over a time period of between about 2 weeks and about 12 months. Alternatively, the first composition may comprise NCG, as NCG co-injection may be employed during production. For example, the first composition may comprise: (i) 95 wt. % steam and/or solvent and 5 wt. % NCG; (ii) 90 wt. % steam and/or solvent and 10 wt. % NCG; (iii) 85 wt. % steam and/or solvent and 15 wt. % NCG; or (iv) 80 wt. % steam and/or solvent and 20 wt. % NCG. Likewise, the second composition may comprise substantial amounts of steam and/or solvent. In particular, the second composition may comprise substantial amounts of steam if a significant amount of solvent was used during hydrocarbon production such that a late-life solvent-recovery protocol is desirable. For example, the second composition may comprise: (i) 10 wt. % steam and 90 wt. % NCG; (ii) 20 wt. % steam and 80 wt. % NCG; (iii) 30 wt. % steam and 70 wt. % NCG; or (iv) 40 wt. % steam and 60 wt. % NCG. With respect to the time period, a ramp-down protocol may last: (i) between about 6 months and about 36 months; (ii) between about 2 months and about 6 months; (iii) between 6 months and about 12 months; or (iv) between about 12 months and about 24 months. A ramp-down protocol may be followed by a blow-down protocol as set out below.

In the context of the present disclosure, blowdown may comprise a shift from an injection fluid composition primarily comprising steam and/or solvent to an injection mixture to an injection fluid composition primarily comprising NCG over the course of less than two weeks and then maintained for a period of weeks or months. For example, during blowdown the injection fluid may be transitioned from a first composition of about 100 wt. % steam and/or solvent and about 0 wt. % NCG to a second compositions comprising about 0 wt. % steam and/or solvent and about 100 wt. % NCG over the course of about 2 weeks and then maintained for a time period between about 2 weeks and about 12 months. Alternatively, the first composition may comprise NCG, as NCG co-injection may be employed during production. For example, the first composition may comprise: (i) 95 wt. % steam and/or solvent and 5 wt. % NCG; (ii) 90 wt. % steam and/or solvent and 10 wt. % NCG; (iii) 85 wt. % steam and/or solvent and 15 wt. % NCG; or (iv) 80 wt. % steam and/or solvent and 20 wt. % NCG. Likewise, the second composition may comprise substantial amounts of steam and/or solvent. In particular, the second composition may comprise substantial amounts of steam if a significant amount of solvent was used during hydrocarbon production such that a late-life solvent-recovery protocol is desirable. For example, the second composition may comprise: (i) 10 wt. % steam and 90 wt. % NCG; (ii) 20 wt. % steam and 80 wt. % NCG; (iii) 30 wt. % steam and 70 wt. % NCG; or (iv) 40 wt. % steam and 60 wt. % NCG. With respect to the time period, a blowdown protocol may last: (i) between about 2 weeks and about 2 months; (ii) between about 2 months and about 4 months; (iii) between 4 months and about 8 months; or (iv) between about 8 months and about 36 months. A blow-down protocol may be initiated directly after a production protocol, or after a ramp-down protocol.

In the context of the present disclosure, orchestrating a production phase by injecting a production-phase injection fluid into the reservoir and modulating production of hydrocarbon-containing fluids may involve manipulating: (i) production pump rates; (ii) injection rates; (iii) injection fluid composition; or (iv) a combination thereof. Likewise, orchestrating a solvent-recovery phase by injecting a solvent-recovery-phase injection fluid into the reservoir and modulating production of solvent-containing fluids from the reservoir may involve manipulating: (i) production pump rates; (ii) injection rates; (iii) injection fluid composition; or (iv) a combination thereof.

In the context of the present disclosure, production pump rates may comprise production pump speed and production flow rates. Production pump rates may be modulated based on one of: a component-flow-rate constraint, a phase-flow-rate constraint, or a total-flow-rate constraint. Optimization may be necessary because: (i) gas locking of the pump may place a limit on how much gas can be produced, which forces a natural constraint to gas production; (ii) higher gas-production rates generally correlated with higher oil-production rates, but they also generally require higher gas-injection rates be to maintain reservoir pressure; and/or (iii) too much gas production may create gas zones and/or channels between the injection well and production well, which may limit oil production. These three phenomena may compound to ensure that the maximum gas production is not always optimal, and the pump rates may be used to tune wellbore and reservoir rates to achieve improved production rates. Generally, this may mean allowing for a small liquid head above the production well, that may be achieved by slowing or increasing pump speed.

In the context of the present disclosure, such manipulations may result in a temperature/pressure transition from a first regime (such as one associated with a production phase) to a second regime (such as one associated with a solvent-recovery phase).

In select embodiments of the present disclosure, the first regime is SDP, and under the first regime, the bottom-hole pressure-temperature condition may comprise a bottom-hole temperature between about 70° C. and about 200° C. or between about 180° C. and about 250° C. In select embodiments of the present disclosure, under the first regime, the bottom-hole pressure-temperature condition may comprise a bottom-hole pressure between about 100 kPa and about 5000 kPa (such as between about 2000 kPa and about 3300 kPa).

In select embodiments of the present disclosure, the first regime is SAP, and under the first regime, the bottom-hole pressure-temperature condition may comprise a bottom-hole temperature between about 150° C. and about 250° C. or between about 180° C. and about 240° C. In select embodiments of the present disclosure, under the first regime, the bottom-hole pressure-temperature condition may comprise a bottom-hole pressure between about 100 kPa and about 5000 kPa (such as between about 2000 kPa and about 3300 kPa).

In select embodiments of the present disclosure, under the second regime, the bottom-hole pressure-temperature condition may comprise a bottom-hole temperature between about 70° C. and about 200° C. or between about 180° C. and about 250° C.). In select embodiments of the present disclosure, under the second regime, the bottom-hole pressure-temperature condition may comprise a bottom-hole pressure between about 100 kPa and about 5000 kPa (such as between about 2000 kPa and about 3300 kPa).

In the context of the present disclosure, "casing gas(es)" are those which surface via the annular space between the production tubing and the casing of a production well. Generally, casing gas contains small molecule hydrocarbons (mostly $CH_4$) and quantities of $CO_2$ and $H_2S$. Casing gas is typically piped from a wellhead to a facility for processing. Managing and piping casing gas to suitable processing facilities may result in piping degradation or corrosion of the piping due to the corrosive nature of $H_2S$. Typical treatment of $H_2S$ is expensive and requires a chemical protocol, meaning that an environmentally regulated waste disposal scheme and rigorous equipment maintenance procedures are required. In some instances, casing-gas re-injection is used to mitigate these effects. In the context of the present disclosure, "casing-gas re-injection" involves adding at least a portion of the casing gas produced from the production well to the injection fluid used for hydrocarbon production and/or solvent recovery. Such protocols may employ a compressor or an educator as described in Canadian Patent Application CA 2,884,990 A1.

Figure 2:
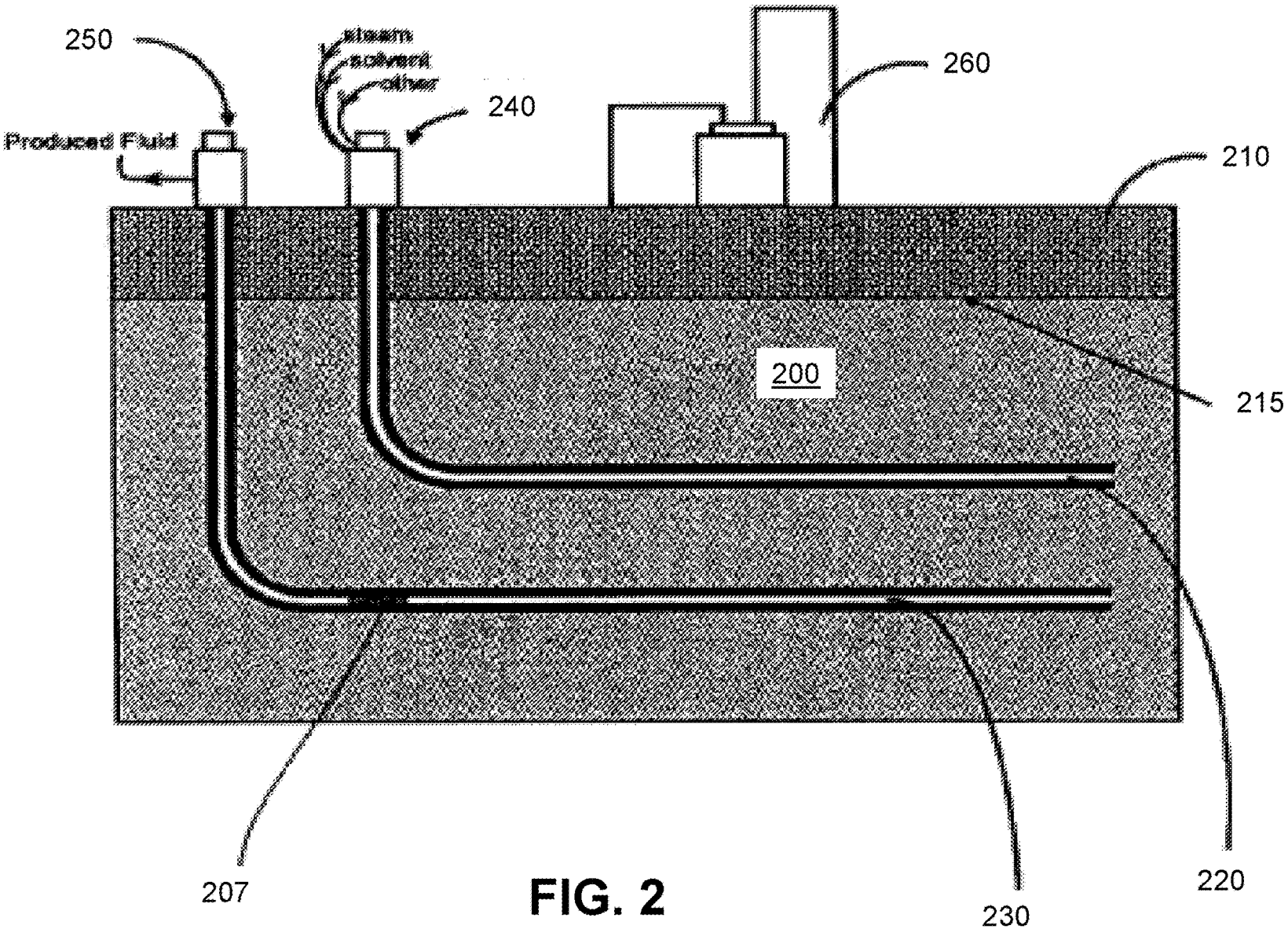
FIG. 2 shows a schematic illustration of a typical well pair configuration in a hydrocarbon reservoir, which may be operable to implement an embodiment of the present disclosure.

FIG. 2 schematically illustrates a typical well pair configuration in a hydrocarbon reservoir 200, which can be operated to implement an embodiment of the present disclosure. The well pair may be configured and arranged similar to a typical well pair configuration for SAGD operations.

As illustrated, the reservoir 200 contains heavy hydrocarbons below an overburden 210. Under natural conditions before any treatment, reservoir 200 is at a relatively low temperature, such as about 12 C, and the reservoir pressure may be from about 0.1 to about 4 MPa, depending on the location and other characteristics of the reservoir.

The well pair includes an injection well 220 and a production well 230, which have horizontal sections extending substantially horizontally in reservoir 200, and which are drilled and completed for injecting injection fluids and producing hydrocarbons from reservoir 200. As depicted in FIG. 1, the well pair is typically positioned away from the overburden 210 and near the bottom of the pay zone or geological stratum in reservoir 200, as can be appreciated by those skilled in the art.

As is typical, injection well 220 may be vertically spaced from production well 230, such as at a distance of about 3 to 8 m, e.g., 5 m. The distance between the injection well and the production well may vary and may be selected to optimize the operation performance within technical and economical constraints, as can be understood by those skilled in the art. In select embodiments of the present disclosure, the horizontal sections of wells 220 and 230 may have a length of about 800 m. In other embodiments, the length may be varied as can be understood and selected by those skilled in the art. Wells 220 and 230 may be configured and completed according to any suitable techniques for configuring and completing horizontal in situ wells known to those skilled in the art. Injection well 220 and production well 230 may also be referred to as the "injector" and "producer", respectively.

The overburden 210 may be a cap layer or cap rock. Overburden 210 may be formed of a layer of impermeable material such as clay or shale. A region in the reservoir 100 just below and near overburden 210 may be considered as an interface region 215.

As illustrated, wells 220 and 230 are connected to respective corresponding surface facilities, which typically include an injection surface facility 240 and a production surface facility 250. Surface facility 240 is configured and operated to supply injection fluids, such as steam and solvent, into injection well 220. Surface facility 250 is configured and operated to produce fluids collected in production well 230 to the surface. Each of surface facilities 240, 250 includes one or more fluid pipes or tubing for fluid communication with the respective well 220 or 230. As depicted for illustration, surface facility 240 may have a supply line connected to a steam generation plant for supplying steam for injection, and a supply connected to a solvent source for supplying the solvent for injection. Optionally, one or more additional supply lines may be provided for supplying other fluids, additives or the like for co-injection with steam or the solvent. Each supply line may be connected to an appropriate source of supply (not shown), which may include, for example, a steam generation plant, a boiler, a fluid mixing plant, a fluid treatment plant, a truck, a fluid tank, or the like. In select embodiments of the present disclosure, co-injected fluids or materials may be pre-mixed before injection. In other embodiments, co-injected fluids may be separately supplied into injection well 220. In particular, surface facility 240 is used to supply steam and a selected solvent into injection well 220. The solvent may be pre-mixed with steam at surface before co-injection. Alternatively, the solvent and steam may be separately fed into injection well 220 for injection into reservoir 200. Optionally, surface facility 240 may include a heating facility (not separately shown) for pre-heating the solvent before injection.

As illustrated, surface facility 250 includes a fluid transport pipeline for conveying produced fluids to a downstream facility (not shown) for processing or treatment. Surface facility 250 includes necessary and optional equipment for producing fluids from production well 230, as can be understood by those skilled in the art. An embodiment of surface facility 250 includes one or more valves for regulating the fluid flow in the liquid line of the produced fluid. The valve(s) may be a choke valve, such as an inline globe valve. The valve may be selected and configured to control the "backpressure" and the flow rate in the liquid line (also referred to as the emulsion line in the art).

Other necessary or optional surface facilities 260 may also be provided, as can be understood by those skilled in the art. For example, surface facilities 260 may include one or more of a pre-injection treatment facility for treating a material to be injected into the formation, a post-production treatment facility for treating a produced material, a control or data processing system for controlling the production operation or for processing collected operational data. Surface facilities 240, 250 and 260 may also include recycling facilities for separating, treating, and heating various fluid components from a recovered or produced reservoir fluid. For example, the recycling facilities may include facilities for recycling water and solvents from produced reservoir fluids.

Injection well 220 and production well 230 may be configured and completed in any suitable manner as can be understood or is known to those skilled in the art, so long as the wells are compatible with injection and recovery of heavy hydrocarbons. For example, in different embodiments, the well completions may include perforations, slotted liner, screens, and/or outflow control devices such as in injection well 220. For simplicity, other necessary or optional components, tools or equipment that are installed in the wells are not shown in the drawings as they are not particularly relevant to the present disclosure.

The methods of the present disclosure may be executed as part of a broader production lifecycle comprising a start-up phase, a ramp-up phase, a production phase, and a ramp-down/blowdown phase. In an exemplary start-up phase, fluid communication between wells 220 and 230 is established in a manner that may be similar to the initial start-up phase in a conventional SAGD process. To permit drainage of mobilized hydrocarbons and condensate to production well 230, fluid communication between wells 220, 230 must be established. Fluid communication refers to fluid flow between the injection and production wells. Establishment of such fluid communication typically involves mobilizing viscous hydrocarbons in the reservoir to form a drainage fluid and removing the drainage fluid to create a porous pathway between the wells. In the context of the present disclosure, a drainage fluid may comprise a liquid phase and a gas phase, and the liquid phase may comprise mobilized hydrocarbons. To form a drainage fluid, viscous hydrocarbons may be mobilized by heating such as by injecting or circulating pressurized steam, solvent, or hot water through injection well 220 or production well 230. In some cases, steam may be injected into, or circulated in, both injection well 220 and production well 230 for faster start-up. A pressure differential may be applied between injection well 220 and production well 230 to promote steam/hot water penetration into the porous reservoir area that lies between the wells of the well pair. The pressure differential may promote fluid flow and convective heat transfer to facilitate communication between the wells.

As is typical, the injection and production wells 220, 230 have terminal sections that are substantially horizontal and substantially parallel to one another. A person of skill in the art will appreciate that while there may be some variation in the vertical or lateral trajectory of the injection or production wells, causing increased or decreased separation between the wells, such wells for the purpose of this application will still be considered substantially horizontal and substantially parallel to one another. Spacing, both vertical and lateral, between injection wells and production wells may be optimized for establishing start-up or based on reservoir conditions.

Additionally or alternatively, other techniques may be employed during the start-up phase. For example, to facilitate fluid communication, a solvent may be injected into the reservoir region around and between the injection and production wells 220, 230. The region may be soaked with a solvent before or after steam injection. An example of start-up using solvent injection is disclosed in CA 2,698,898. In further examples, the start-up phase may include one or more start-up processes or techniques disclosed in CA 2,886,934, CA 2,757,125, or CA 2,831,928.

Once fluid communication between injection well 220 and production well 230 has been achieved, oil production or recovery may commence. As the oil production rate is typically low initially and will increase as the production chamber develops, the early production phase is known as the "ramp-up" phase. During the ramp-up phase, steam, with or without a solvent, is typically injected continuously into injection well 220, at constant or varying injection pressure and temperature. At the same time, drainage fluids comprising mobilized heavy hydrocarbons and aqueous condensate are continuously removed from production well 230. During ramp-up, the zone of communication between injection well 220 and production well 230 may continue to expand axially along the full length of the horizontal portions of wells 220, 230.

As the injected fluid heats up reservoir 100, heavy hydrocarbons in the heated region are softened, resulting in reduced viscosity. Further, as heat is transferred from steam to reservoir 200, steam and solvent vapour condense. The aqueous and solvent condensate and mobilized hydrocarbons will drain downward due to gravity. As a result of depletion of the heavy hydrocarbons, a porous region is formed in reservoir 200, which is referred to herein as a "production chamber". When a production chamber is filled with mainly steam, it is commonly referred to in the art as a "steam chamber." As the drainage fluids drain towards production well 230, they are taken up into production well 230 via one or more of the plurality of flow-inlet components 270. As discussed in detail below, individual flow-inlet components may be configured to choke-off gas ingress, such that the plurality flow-inlet components—taken together—serve to prioritize emulsion flow into the production well 230. As such, the drainage fluids collecting in proximity to the production well 230 may be characterized by higher gas:liquid concentration ratios than the production fluids inside the production well 230. However, this may not be the case, for example due to the possibility of fluids vapourizing when substantial pressure differentials exist across the liner. Accordingly, in the context of the present disclosure, production fluids and drainage fluids are not used interchangeably. In the context of the present disclosure, production fluids are those which are transferred to the surface, such as by gas lifting or through pumping with a pump 207 as is known to those skilled in the art.

At the point of injection into the reservoir 200, or in the injection well 220, the injected fluid/mixture may be at a temperature that is selected to optimize the production performance and efficiency. For example, for a given solvent to be injected the injection temperature may be selected based on the boiling point (or saturation) temperature of the solvent at the expected operating pressure in the reservoir. For propane, the boiling temperature is about 2 C at 0.5 MPa, and about 77 C at 3 MPa. For a different solvent, the injection temperature may be higher if the boiling point temperature of that solvent at the reservoir pressure is higher. In different embodiments and applications, the injection temperature may be substantially higher than the boiling point temperature of the solvent by, e.g., 5 C to 200 C, depending on various operation and performance considerations. In some embodiments, the injection temperature may be from about 50 C to about 320 C, and at a pressure from about 0.5 MPa to about 12.5 MPa, such as from 0.6 MPa to 5.1 MPa or up to 10 MPa. At an injection pressure of about 3 MPa, the injection temperature for propane may be from about 80 C to about 250 C, and the injection temperature for butane may be from about 100 C to about 300 C. In the context of the present disclosure, the term "production-phase injection profile" is used to define the temperature, injection rate (pressure), and/or composition of the injection fluid(s) used to prioritize hydrocarbon production. Those skilled in the art, who have benefitted from the teachings of the present disclosure, will appreciate that the production-phase injection profile may vary in different embodiments depending on, for example, the type of hydrocarbon recovery process implemented or the mobilizing agents selected, as well as various factors and considerations for balancing and optimizing production performance and efficiency. The injection temperature should not be too high as a higher injection temperature will typically require more heating energy to heat the injected fluid. Further, the injection temperature should be limited to avoid coking hydrocarbons in the reservoir formation. In some oil sands reservoirs, the coking temperature of the bitumen in the reservoir is about 350 C.

Once injected steam and vapour of the injected solvent enter the reservoir, their temperature may drop under the reservoir conditions. The temperatures at different locations in the reservoir will vary as typically regions further away from injection well 220, or at the edges of the production chamber, are colder. During operations, the reservoir conditions may also vary. For example, the reservoir temperatures can vary from about 10 C to about 275 C, and the reservoir pressures can vary from about 0.6 MPa to about 7 MPa depending on the stage of operation. The reservoir conditions may also vary in different embodiments. As noted above, injected steam and solvent condense in the reservoir mostly at regions where the reservoir temperature is lower than the dew point temperature of the solvent at the reservoir pressure. Condensed steam (water) and solvent can mix with the mobilized bitumen to form drainage fluids. It is expected that in a typical reservoir subjected to steam/solvent injection, the drainage fluids include a stream of condensed steam (or water, referred to as the water stream herein).

Thus, injected steam and vapour of the solvent both assist to mobilize the viscous hydrocarbons in the reservoir 200. A drainage fluid formed in the production chamber may include oil, condensed steam (water), and a condensed phase of the solvent. The reservoir fluid is drained by gravity along the edge of production chamber into production well 230 for recovery of oil.

In various embodiments, the solvent may be selected so that dispersion of the solvent in the production chamber, as well as in the drainage fluid increases the amount of oil contained in the fluid and increases the flow rate of the oil stream from production chamber to the production well 230. When solvent condenses (forming a liquid phase) in the production chamber, it may be dispersed in the drainage fluid to increase the rate of drainage of the oil stream from the reservoir 200 into the production well 230.

After the produced fluids are surfaced, the solvent and water may be separated from oil in the produced fluids by a method known in the art depending on the particular solvent(s) involved. The separated water and solvent can be further processed by known methods, and recycled to the injection well 220. In some embodiments, the solvent is also separated from the produced water before further treatment, re-injection into the reservoir, or disposal.

As mentioned above, the production chamber forms and expands due to depletion of hydrocarbons and other in situ materials from regions of reservoir 200 above the injection well 220. Injected steam/solvent vapour tend to rise up to reach the top of production chamber before they condense, and steam/solvent vapour can also spread laterally as they travel upward. During early stages of chamber development, the production chamber expands upwardly and laterally from injection well 220. During the ramp-up phase and the early production phase, the production chamber can grow vertically towards overburden 210. At later phases, after the production chamber has reached the overburden 210, the production chamber may expand mainly laterally. Depending on the size of reservoir 200 and the pay therein and the distance between injection well 220 and overburden 210, it can take a long time, such as many months and up to two years, for the production chamber to reach overburden 210, when the pay zone is relative thick as is typically found in some operating oil sands reservoirs. However, it will be appreciated that in a thinner pay zone, the production chamber can reach the overburden sooner. The time to reach the vertical expansion limit can also be longer in cases where the pay zone is higher or highly heterogeneous, or the formation has complex overburden geologies such as with inclined heterolithic stratification (HIS), top water, top gas, or the like.

In some embodiments of the present disclosure, at early stages of oil production, steam may be injected without a solvent. The solvent may be added as a mobilizing agent after the production chamber has reached or is near the top of the pay zone, e.g., near or at the lower edge of the overburden 210 or after the oil production rate has peaked. The solvent can dissolve in oil and dilute the oil stream so as to increase the mobility and flow rate of hydrocarbons or the diluted oil stream towards production well 230 for improved oil recovery. Other materials in liquid or gas form may also be added to the injection fluid to enhance recovery performance.

The start-up, ramp-up, and production phases may be conducted according to any suitable conventional techniques known to those skilled in the art except the aspects described herein, and the other aspects will therefore not be detailed herein for brevity. As a first example, during production, such as at the end of an initial production period with steam injection, the formation temperature in the production chamber can reach about 235 C and the pressure in the production chamber may be about 3 MPa. The temperature or pressure may vary by about 10% to 20%. As a second example, during production and/or during solvent recovery, the methods of the present disclosure may further comprise one or more intermittent periods of steam-only injection.

As mentioned earlier, in a particular embodiment where propane is used as the solvent, the injection temperature of the steam-propane mixture may be about 80 C to about 250 C. In other embodiments, the injection temperature may be selected based on the boiling point temperature of the solvent at the selected injection pressure. Of course, depending on the reservoir and the application, the chamber temperature and pressure may also vary in different embodiments. For example, in various embodiments, steam may be injected at a temperature from about 150 C to about 330 C and a pressure from about 0.1 MPa to about 12.5 MPa. In some embodiments, the highest temperature in the production chamber may be from about 50 C to about 350 C and the pressure in the production chamber may be from about 0.1 MPa to about 7 MPa.

A suitable solvent may be selected based on a number of considerations and factors as discussed herein. The solvent should be injectable as a vapour, and can dissolve at least one of the heavy hydrocarbons to be recovered from reservoir 200 in the solvent-steam process for increasing mobility of the heavy hydrocarbons. The solvent may be a viscosity-reducing solvent, which reduces the viscosity of the heavy hydrocarbons in reservoir 200.

It is noted that steam injection with solvent injection can conveniently facilitate transportation of the solvent as a vapour with steam to the steam front. Steam is typically a more efficient heat-transfer fluid than a solvent, and can increase the reservoir temperature more efficiently and more economically, or maintain the production chamber at a higher temperature.

The solvent is injected into reservoir 200 in a vapour phase. Injection of the solvent in a vapour phase allows the solvent vapour to travel in the production chamber and condense at a region away from injection well 220. Allowing solvent to travel in production chamber before condensing may achieve beneficial effects. For example, oil production performance, such as indicated by one or more of oil production rate, cumulative steam to oil ratio (cSOR), and overall efficiency, may be improved. Injection of solvent in the gaseous phase, rather than a liquid phase, may allow vapour to rise in production chamber before condensing so that condensation occurs away from injection well 220. It is noted that injecting solvent vapour into the production chamber does not necessarily require solvent be fed into the injection well in vapour form. The solvent may be heated downhole and vaporized in the injection well 220 in some embodiments. Alternatively, the solvent may be injected into another well or other wells for more efficient delivery of the solvent to desired locations in the reservoir. The additional well(s) may include a vertical well, a horizontal well, or a well drilled according to the well drilled using Wedge Well™ technology.

The total injection pressure for solvent and steam co-injection may be the same or different than the injection pressure during a conventional SAGD production process. For example, the injection pressure may be maintained at between 2 MPa and 3.5 MPa, or up to 5.5 MPa. In another example, steam may be injected at a pressure of about 3 MPa initially, while steam and solvent are co-injected at a pressure of about 2 MPa to about 3.5 MPa during co-injection.

The solvent may be heated before or during injection to vaporize the solvent. During injection, the solvent may not exist exclusively in the gas phase as pressure and temperature profiles vary along the injection path. Additionally or alternatively, solvent may be mixed or co-injected with steam to heat the solvent to vaporize it and to maintain most of the solvent in vapour phase. Depending on whether the solvent is pre-heated at surface, the weight ratio of steam in the injection stream should be high enough to provide sufficient heat to the co-injected solvent to maintain the injected solvent in the vapour phase along the injection path. If the feed solvent from surface is in the liquid phase, more steam may be required to both vaporize the solvent and maintain the solvent in the vapour phase as the solvent travels through the production chamber.

In different embodiments, co-injection of steam and the solvent may be carried out in a number of different ways or manners as can be understood by those skilled in the art. For example, co-injection of the solvent and steam into the production chamber may include gradually increasing the weight ratio of the solvent in the co-injected solvent and steam, and gradually decreasing the weight ratio of steam in the co-injected solvent and steam. At a later stage, the solvent content in the co-injected solvent and steam may be gradually decreased, and the steam content in the co-injected solvent and steam may be gradually increased. For example, depending on market factors, the cost of solvent may change over the life of a steam-solvent process. During or after the solvent-steam process, it may be of economic benefit to gradually decrease the solvent content and gradually increase the steam content. Likewise economic considerations may influence the amount of NCG injected and the duration/timing of production, wind-down, and/or blowdown.

Once the oil production process is completed, the operation may enter a ramp-down and/or "blowdown" phase as discussed in detail below.

Figure 3:
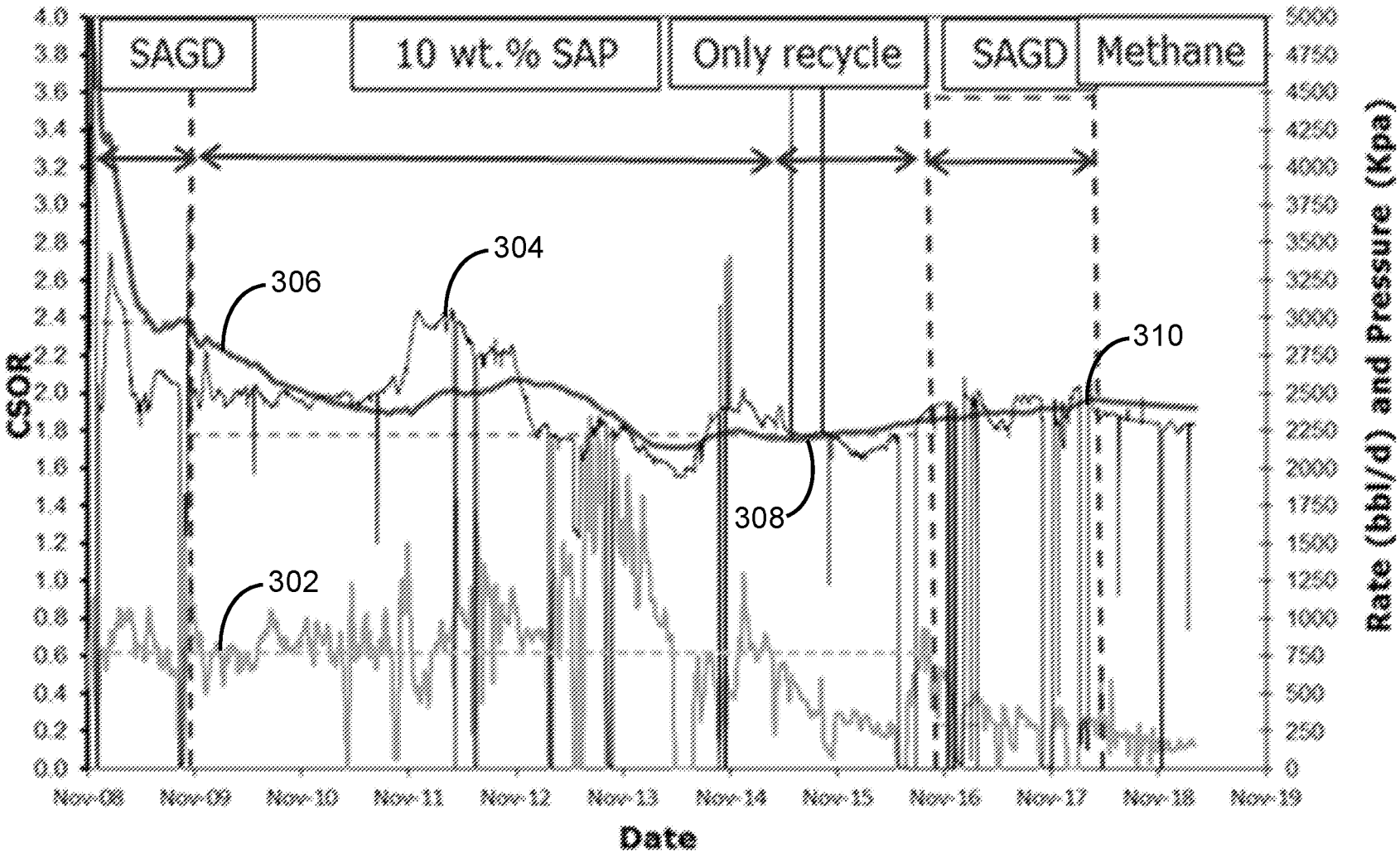
FIG. 3 shows filed data from a pilot-scale hydrocarbon-production process featuring a production-phase injection fluid comprising 10 wt. % butane.

FIG. 3 shows field data for a well pair configured substantially as set out with respect to FIG. 2. In FIG. 3, a plot of oil-production rate as a function of time is identified with reference number 302, a plot of injection pressure as a function of time is identified with reference number 304, and a plot of cumulative steam-to-oil ratio (cSOR) is identified with reference number 306. The date in FIG. 3 covers a SAP production phase that employed an injection fluid comprising about 10 wt. % butane (solvent) and about 90 wt. % steam. The SAP production phase was preceded by a SAGD phase. From about July 2017 to about April 2019, co-injection was executed with different proportions, not monotonically decreasing steam. The SAP production phase was followed by a SAGD phase, which was followed by a short wind-down phase and a blowdown phase. In the blowdown phase, the injection fluid was methane.

Figure 4:
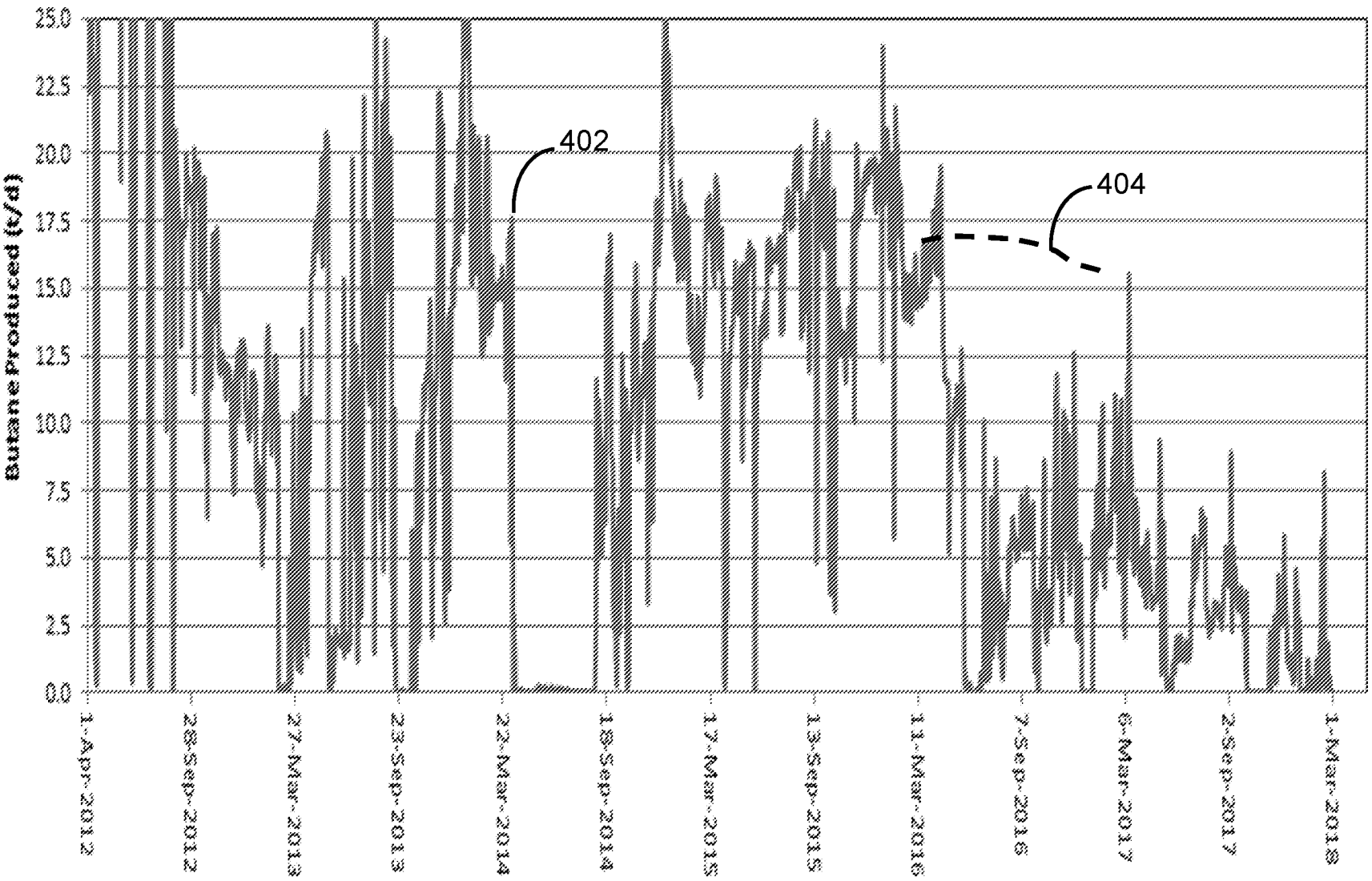
FIG. 4 shows a plot of butane recovery as a function of time for the pilot-scale process, and FIG. 4 includes a simulation-derived extrapolation of butane recovery resulting from an alternate solvent-recovery-injection profile that relates to a method of the present disclosure.

The data in FIG. 3 highlight the importance of tailoring the blowdown approach to the production-phase injection profile. The preferred time to initiate blowdown is indicated with reference number 308 (when cSOR started to increase in March 2015) and the actual blowdown initiation time is indicated with 310. During this period steam-only injection resulted in an increase in chamber temperature from about 170 C to about 190 C, and resulted in reduction in butane solubility by over 20% in bitumen. Delaying blowdown was detrimental to solvent recovery rate, bitumen production and cSOR. To achieve the same solvent recovery rate, the well pair had to be operated for longer period of time, which significantly increased the operating costs. FIG. 4 provides additional data from the same process. In FIG. 4, a plot of solvent recovery as a function of time is indicated by reference number 402, and an extrapolation resulting from a blowdown protocol in accordance with a method of the present disclosure is indicated with reference number 404.

In select embodiments of the present disclosure, blowdown protocols include steam to provide an enthalpic boost. In select embodiments of the present disclosure, the enthalpic boost is provided by pre-heating the NCG. The NCG may be heated before injecting into the reservoir, or the NCG may be heated in situ, (for example using an electric heater or HotRod™ technology).

Without being bound to any particular theory, the physics underlying the present disclosure may relate to lower temperature conditions during SAP- and/or SDP-based production as compared with SAGD. The temperature of the injected fluids (and consequently, the reservoir) will be lower with an increase in solvent concentration. The methods of the present disclosure are designed to increase the concentration of solvent in the gas phase and decrease the concentration of solvent in the liquid oil phase by introducing sufficient thermal energy.

During the blowdown stage, a non-condensable gas may be injected into the reservoir to replace steam or solvent. For example, the non-condensable gas may be methane. In addition, methane may enhance hydrocarbon production, for example by about 10% within 1 year, by pushing the already injected solvent through the chamber.

During the solvent-recovery phase, oil recovery or production may continue with production operations being maintained. When methane is used for blowdown, oil production performance may decline over time as the growth of the vapour front in production chamber slows under methane gas injection.

Suitable solvents for the production phase may include C3 to C5 hydrocarbons such as, propane, butane, or pentane. The solvent may include a mixture of hydrocarbons such as diluent. Additionally or alternatively, a C6 hydrocarbon such as hexane could be employed. A combination of solvents including C3-C6 hydrocarbons and one or more heavier hydrocarbons may also be suitable in some embodiments. Likewise, suitable solvents may include light alcohols, and/or light amines. Solvents that are more volatile, such as those that are gaseous at standard temperature and pressure (STP), or significantly more volatile than steam at reservoir conditions, such as propane or butane, or even methane, may be beneficial in some embodiments.

For selecting a suitable solvent, the properties and characteristics of various candidate solvents may be considered and compared. For a given selected solvent, the corresponding operating parameters during co-injection of the solvent with steam should also be selected or determined in view the properties and characteristics of the selected solvent.

In particular, the injection temperature should be sufficiently high and the injection pressure should be sufficiently low to ensure a substantial portion of the solvent will be injected in the vapour phase into the production chamber. In this context, injection temperature and injection pressure refer to the temperature and pressure of the injected fluid in the injection well, respectively. The temperature and pressure of the injected fluid in the injection well may be controlled by adjusting the temperature and pressure of the fluid to be injected before it enters the injection well. The injection temperature, injection pressure, or both, may be selected to ensure that the solvent is in the gas phase upon injection from the injection well into the production chamber. Solvents may be selected having regard to reservoir characteristics such as, the size and nature of the pay zone in the reservoir, properties of fluids involved in the process, and characteristics of the formation within and around the reservoir. For example, a relatively light hydrocarbon solvent such as propane may be suitable for a reservoir with a relatively thick pay zone, as a lighter hydrocarbon solvent in the vapour phase is typically more mobile within the heated production chamber.

Additionally or alternatively, solvent selection may include consideration of the economics of heating a selected particular solvent to a desired injection temperature. For example, as can be appreciated by those skilled in the art, lighter solvents, such as propane and butane, can be efficiently injected in the vapour phase at relatively low temperatures at a given injection pressure. In comparison, efficient pure steam injection in a SAGD process typically requires a much higher injection temperature, such as about 200 C or higher.

Heavier solvents typically also require a higher injection temperature. For example, pentane may need to be heated to about 190 C for injection in the vapour phase at injection pressures up to about 3 MPa. In comparison, a light solvent such as propane may be injected at temperatures as low as about 50 to about 70 C depending on the reservoir pressure.

Different solvents or solvent mixtures may be suitable candidates. For example, the solvent may be propane, butane, or pentane. A mixture of propane and butane may also be used in an appropriate application. It is also possible that a selected solvent mixture may include heavier hydrocarbons in proportions that are, for example, low enough that the mixture still satisfies the above described criteria for selecting solvents.

EXAMPLES

A simplified economic model that computes a net present value (NPV) function provides context for the methods of the present disclosure. Some of the assumptions used in the economic model are set out in Table 1.

TABLE 1

Select economic variables and assumptions used to compute NPV

| Parameter | Value |
|---|---|
| Well Pair CAPEX | $2M |
| Realized Oil Price | $126/m$^3$ |
| Solvent Price | $478/t |
| Steam Cost | $9/m$^3$ |
| Water Treatment Cost | $2/m$^3$ |
| Methane Price | $5/MCF |

State-of-the-art simulation protocols were used to illustrate aspects of the present disclosure as described with reference to FIG. 5 to FIG. 8. In the simulations, the reservoir was modeled to be homogenous and 15 m thick. The horizontal permeability of the reservoir was 7 D and vertical permeability was 3.5 D. The well spacing was 100 m. During the blowdown process, the injection well was operated on a gas-injected constraint while the production well was operated on a gas-oil ratio (GOR) constraint. For the different solvent concentrations, the injected steam quality was adjusted using Hysis phase rate simulations.

Figure 5:
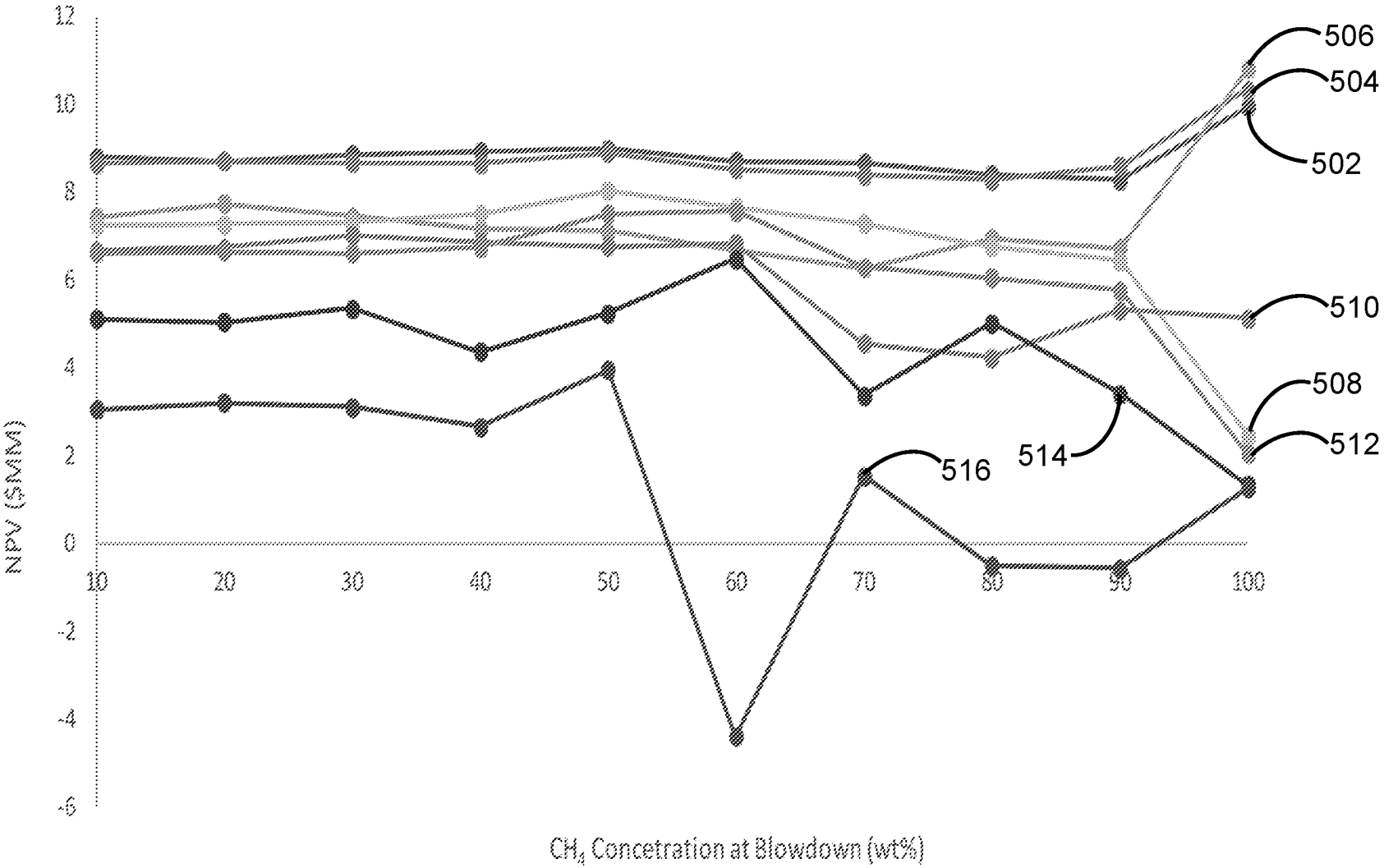
FIG. 5 shows a series of plots of net present value (NPV) as a function of solvent-recovery-phase injection-fluid composition. Each of the plots relates to a particular production-phase protocol, and the series of production-phase protocols differ with respect to solvent concentration in the production-phase injection fluids.

FIG. 5 shows how NCG concentration in blowdown injection fluids influences NPV for a series of hydrocarbon production processes. In instances where NCG concentrations are less than 100%, the remainder of the blowdown injection fluid composition is comprised of steam. The hydrocarbon production processes did not employ casing gas re-injection, and they are indicated by reference numbers as set out in Table 2.

TABLE 2

Reference numbers and solvent content during SAP/SDP in FIG. 5

| Reference number | Solvent Content |
|---|---|
| 502 | 3 wt. % |
| 504 | 10 wt. % |
| 506 | 20 wt. % |
| 508 | 30 wt. % |
| 510 | 40 wt. % |
| 512 | 50 wt. % |
| 514 | 60 wt. % |
| 516 | 70 wt. % |

As can be seen in FIG. 5, the production phases based on low-solvent concentrations 502, 504, and 506 have maximum NPV values when the solvent-recovery-phase injection fluid is 100 wt. % NCG (methane). Moreover, the maximum NPV values are associated with cold methane (i.e. methane that has not been heated). Without being bound to any particular theory, this may be due to the reservoir remaining adequately hot to allow cold methane injection without significantly impacting the effectiveness of the blowdown process.

Figure 6:
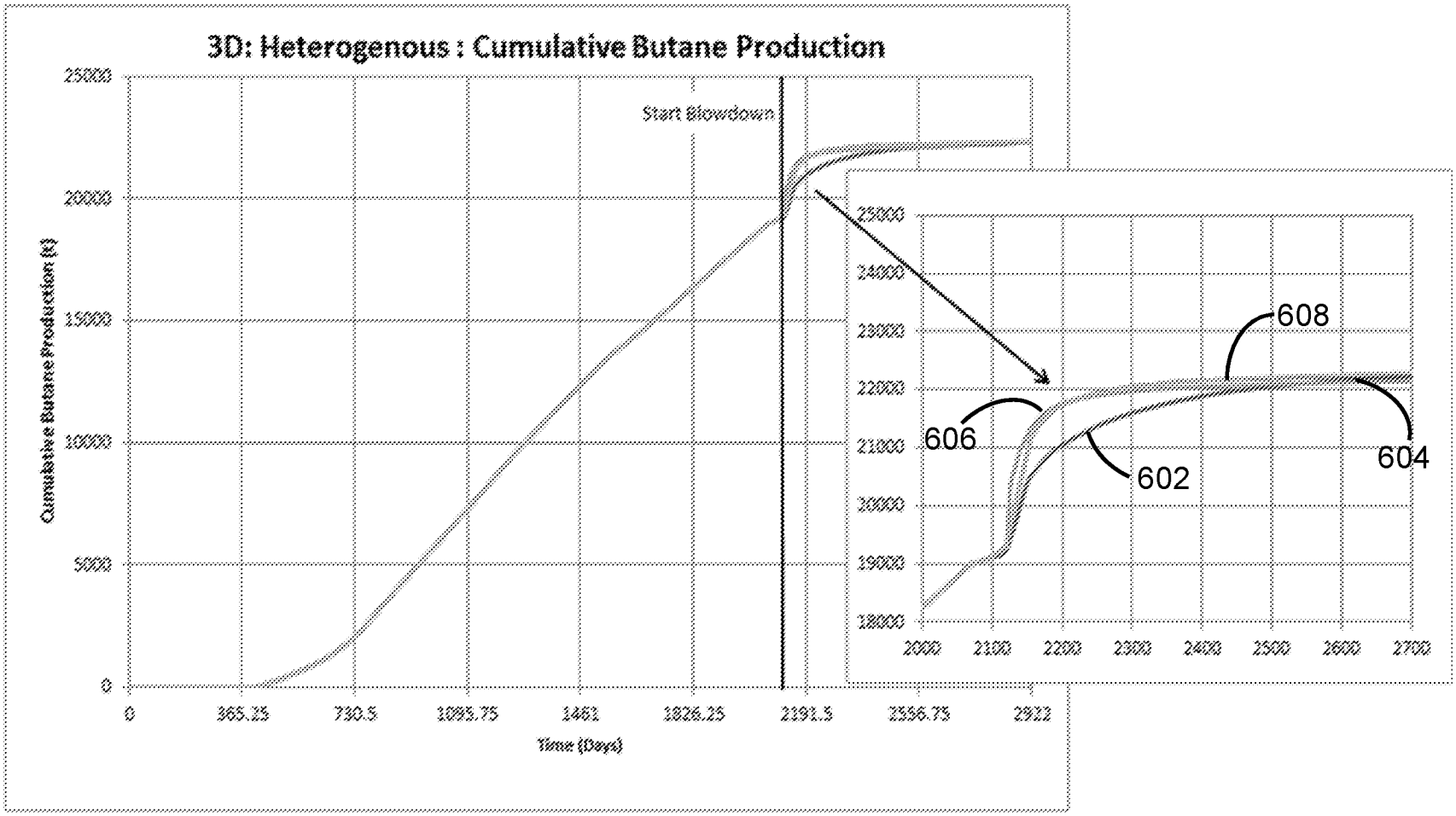
FIG. 6 shows cumulative butane production as a function of time for several blowdown strategies. shows a series of plots of cumulative butane recovery as a function of time. Each of the plots relates to a particular solvent-recovery-phase protocol.

This finding is consistent with simulations and field data from a hydrocarbon production pilot using a production-phase injection fluid comprising about 10 wt. % butane. Simulation data from this pilot are shown in FIG. 6, where plots of cumulative butane production as a function of time are shown for solvent-recovery-phase injection protocols based on steam only (602), methane ramp-up (604), methane only (606), and 1:1 steam:methane (608). The data suggests that there is negligible difference in butane recovery from blowing down with methane only 606 and blowing down with 1:1 steam/methane mixture. Since steam is more considerably more expensive than methane, the data in both FIG. 5 and FIG. 6 suggest that it is more economical to blowdown 10 wt. % SAP by injecting only methane gas during the solvent-recovery phase.

Figure 7:
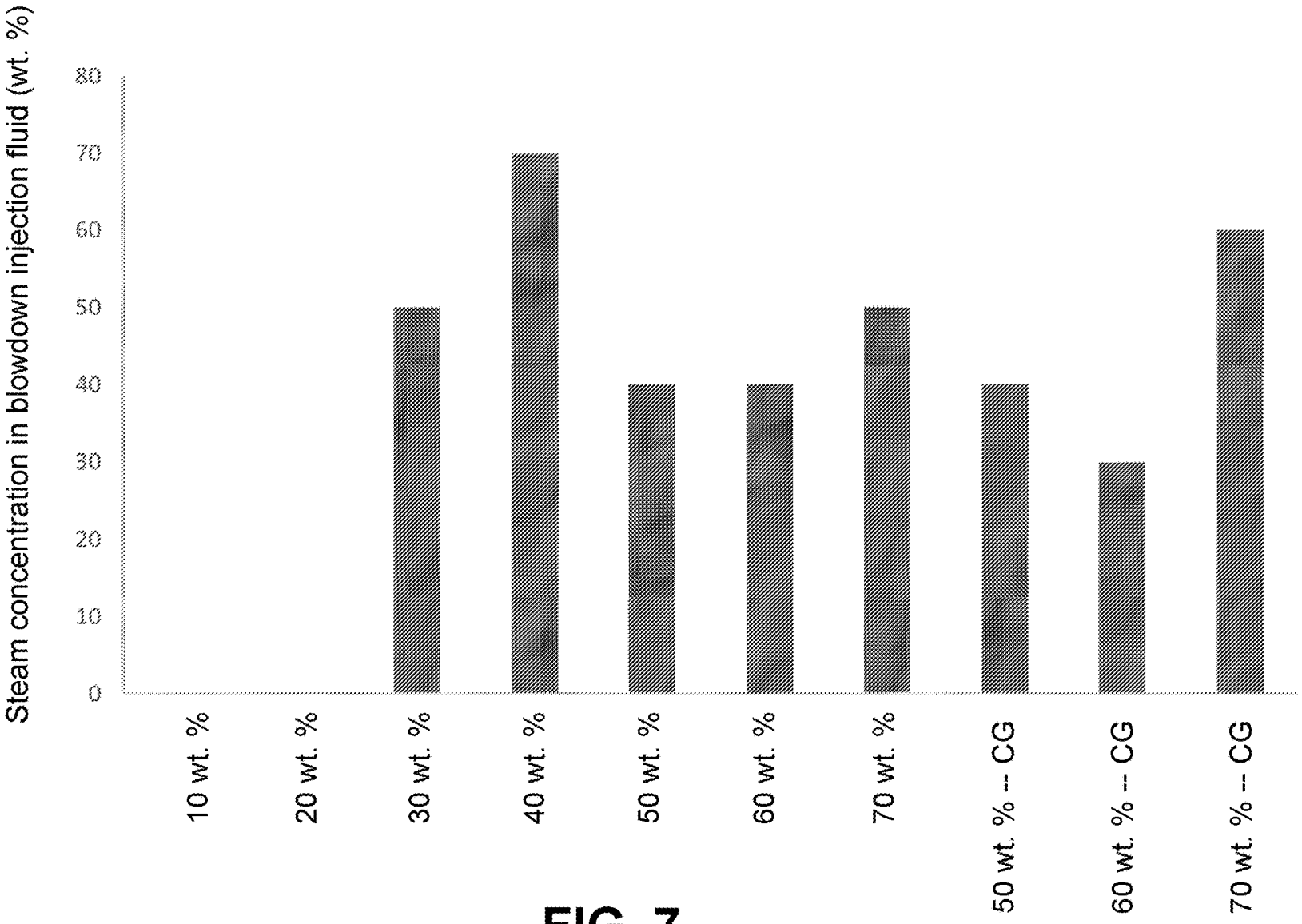
FIG. 7 shows optimal steam concentrations in solvent-recovery-phase injection fluids that are tailored to particular production-phase protocols.

FIG. 7 plots the optimal steam injection concentrations during blowdown for various production-phase injection profiles. Some of the production-phase injection profiles employ casing gas re-injection, and they are marked "CG" in FIG. 7. The data of FIG. 7 suggests that an effective blowdown steam concentration for a typical SDP-based product is higher in the absence of casing gas re-injection that it is when casing gas re-injection is employed. This result is counter-intuitive, and it highlights the importance of tailoring solvent-recovery protocols to the particulars of the production-phase. Those skilled in the art may expect SDP-based production employing casing gas re-injection to require more steam during solvent recovery than those that do not employ casing gas re-injection since methane poisoning is know to reduce reservoir temperatures. Without being bound to any particular theory, this counter-intuitive result may relate to an advantageous partial blowdown effect which causes lower solvent retention when casing gas re-injection is employed. Partial blowdown may occur during casing gas re-injection, because the higher vapour pressures of solvents relative to methane may lead to their preferential dissolution with hydrocarbons. The present results suggest that, under the conditions evaluated, this reduced storage may be more impactful for blowdown than the methane heat poisoning effect.

Figure 8:
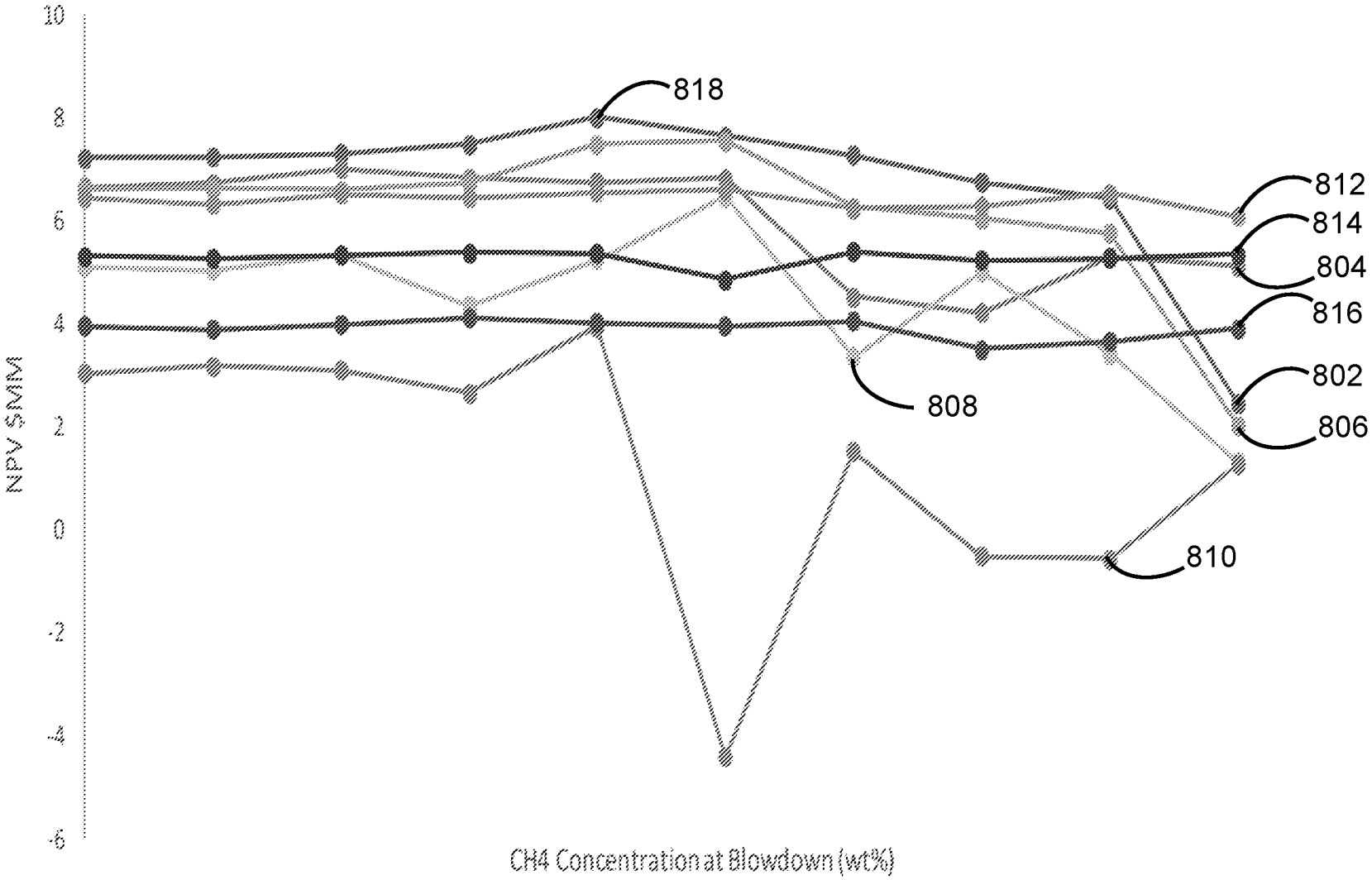
FIG. 8 shows a series of plots of NPV as a function of solvent-recovery-phase injection-fluid composition. Each of the plots relates to a particular production-phase protocol, and the series of production-phase protocols differ with respect to: (i) solvent concentration in the production-phase injection fluids, and (ii) the presence/absence of casing-gas re-injection during hydrocarbon production.

FIG. 8 shows how NCG concentration in blowdown injection fluids influences NPV for a series of production-phase injection protocols. In instances where NCG concentrations are less than 100%, the remainder of the blowdown injection fluid composition is comprised of steam. Some of the production-phase injection protocols employ casing gas re-injection as set out in Table 3 alongside the relevant reference numbers.

TABLE 3

Reference numbers, injection-fluid solvent content, and casing gas re-injection during production-phase injection protocols for FIG. 8

| Reference number | Solvent Content | Casing Gas Re-injection |
|---|---|---|
| 802 | 30 wt. % | No |
| 804 | 40 wt. % | No |
| 806 | 50 wt. % | No |
| 808 | 60 wt. % | No |
| 810 | 70 wt. % | No |
| 812 | 50 wt. % | Yes |
| 814 | 60 wt. % | Yes |
| 816 | 70 wt. % | Yes |

As can be seen in FIG. 8, Comparing: (i) plot 806 vs plot 812; (ii) plot 808 vs plot 814; and/or (iii) plot 810 vs plot 816, 806, 808, and 810 indicates that, in the present context, casing gas re-injection generally correlates with increased NPV. Again, without being bound to any particular theory, this counter-intuitive result may relate to an advantageous partial blowdown effect, which may cause lower solvent retention when casing gas re-injection is employed. Partial blowdown may occur during casing gas re-injection, because the higher vapour pressures of solvents relative to methane may lead to their preferential dissolution with hydrocarbons. The plots in FIG. 8 also provide relevant information for selecting a suitable steam:methane ratio for injection during blowdown. This may be achieved by adopting the steam:methane ratio associated with the maximum point for the particular plot. For example, when selecting a suitable steam:methane ratio for injection during blowdown following a production phase based on 30 wt. % solvent injection without casing-gas reinjection, plot 802 provides the relevant data including a distinct NPV maximum indicated by reference number 818.

In the present disclosure, all terms referred to in singular form are meant to encompass plural forms of the same. Likewise, all terms referred to in plural form are meant to encompass singular forms of the same. Unless defined otherwise, all technical and scientific terms used herein have the same meaning as commonly understood by one of ordinary skill in the art to which this disclosure pertains.

As used herein, the term "about" refers to an approximately +/−10% variation from a given value. It is to be understood that such a variation is always included in any given value provided herein, whether or not it is specifically referred to.

It should be understood that the compositions and methods are described in terms of "comprising," "containing," or "including" various components or steps, the compositions and methods can also "consist essentially of" or "consist of" the various components and steps. Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Although individual embodiments are discussed, the disclosure covers all combinations of all those embodiments. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure. If there is any conflict in the usages of a word or term in this specification and one or more patent(s) or other documents that may be incorporated herein by reference, the definitions that are consistent with this specification should be adopted.

Many obvious variations of the embodiments set out herein will suggest themselves to those skilled in the art in light of the present disclosure. Such obvious variations are within the full intended scope of the appended claims.

The invention claimed is:

1. A method of producing hydrocarbons and recovering solvent from a subterranean reservoir through a production well, comprising:

performing a production phase by injecting a production-phase injection fluid into the reservoir and modulating production through the production well of hydrocarbon-containing fluids, wherein:

the injecting of the production-phase injection fluid is defined at least in part by a production-phase injection profile comprising: (i) a production-phase injection-fluid composition that is constant or variable, (ii) a production-phase injection-fluid temperature that is constant or variable, and (iii) a production-phase injection rate that is constant or variable, the injection-fluid composition comprises a solvent that has a liquid phase, a vapour phase, and a vapourization curve that can be used to define the dominant state of the solvent under reservoir conditions, and the performing of the production phase yields a production-phase bottom-hole pressure-temperature condition measured proximal the production well that lies above the vapourization curve of the solvent when the production-phase bottom-hole pressure-temperature condition is mapped against the vapourization curve of the solvent, such that the dominant state of the solvent under the reservoir conditions proximal the production well is thereby determined to be liquid; and performing a solvent-recovery phase by injecting a solvent-recovery-phase injection fluid into the reservoir and modulating production through the production well of solvent-containing fluids from the reservoir, wherein:

the injecting of the solvent-recovery-phase injection fluid is defined at least in part by a solvent-recovery-phase injection profile comprising: (i) a solvent-recovery-phase injection-fluid composition that is constant or variable and that comprises a non-condensable gas (NCG), (ii) a solvent-recovery-phase injection-fluid temperature that is constant or variable, and (iii) a solvent-recovery-phase injection rate that is constant or variable, and the solvent-recovery-phase injection profile is selected based on the production-phase injection profile and production-well inflow parameters measured during the solvent-recovery phase, and the production through the production well of the solvent-containing fluids from the reservoir is modulated by manipulating production pump rates, injection rates, injection fluid composition, or a combination thereof, to provide a solvent-recovery-phase bottom-hole pressure-temperature condition measured proximal the production well that lies below the vapourization curve of the solvent during at least part of the solvent-recovery phase when the solvent-recovery-phase bottom-hole pressure-temperature condition is mapped against the vapourization curve of the solvent, such that the dominant state of the solvent under the reservoir conditions proximal the production well is thereby determined to be gas.

2. The method of claim 1, wherein the production-phase injection-fluid composition comprises at least about 95 wt. % solvent, the solvent-recovery-phase injection-fluid composition comprises at least about 95 wt. % NCG, and the solvent-recovery-phase injection-fluid temperature is about 100 C.

3. The method of claim 1, wherein the production-phase injection-fluid composition comprises at least about 99 wt. % solvent, the solvent-recovery-phase injection-fluid composition comprises at least about 99 wt. % NCG, and the solvent-recovery-phase injection-fluid temperature is between about 150 C and about 200 C.

4. The method of claim 1, wherein: (i) the production-phase injection-fluid composition comprises between about 50 wt. % and about 95 wt. % solvent, (ii) the solvent-recovery-phase injection-fluid composition comprises between about 0 wt. % and about 5 wt. % NCG exclusive of 0 wt. %, and (iii) the solvent-recovery-phase injection-fluid composition comprises between about 95 wt. % and about 100 wt. % steam.

5. The method of claim 4, wherein the injecting of the production-phase injection fluid comprises a casing-gas reinjection.

6. The method of claim 4, wherein the injecting of the production-phase injection fluid is free of a casing-gas reinjection.

7. The method of claim 1, wherein: (i) the production-phase injection-fluid composition comprises between about 50 wt. % and about 95 wt. % solvent, (ii) the solvent-recovery-phase injection-fluid composition is gradually changed over up to about 24 months so that the solvent-recovery-phase injection-fluid composition eventually comprises between about 80 wt. % and about 100 wt. % NCG, and (iii) the solvent-recovery-phase injection-fluid composition comprises between about 0 wt. % and about 20 wt. % steam.

8. The method of claim 1, wherein: (i) the production-phase injection-fluid composition comprises between about 3 wt. % and about 50 wt. % solvent; and (ii) the solvent-recovery-phase injection-fluid composition initially comprises between about 0 wt. % and about 5 wt. % NCG, and between about 95 wt. % and about 100 wt. % steam, with steam content decreasing non-monotonically so that after three years or less the solvent-recovery-phase injection-fluid comprises between about 90 wt. % and about 100 wt. % NCG, and between about 0 wt. % and about 10 wt. % steam.

9. The method of claim 1, wherein: (i) the production-phase injection-fluid composition comprises between about 3 wt. % and about 50 wt. % solvent, (ii) the solvent-recovery-phase injection-fluid composition is gradually changed over up to about 12 months so that the solvent-recovery-phase injection-fluid composition eventually comprises between about 80 wt. % and about 100 wt. % NCG, and (iii) the solvent-recovery-phase injection-fluid composition comprises between about 0 wt. % and about 20 wt. % steam.

10. The method of claim 1, wherein the performing of the solvent-recovery phase is preceded by an instantaneous steam-to-oil ratio (iSOR) of about 3 during the performing of the production phase, and the production phase is a solvent-aided process (SAP) production phase.

11. The method of claim 1, wherein the performing of the solvent-recovery phase is preceded by an instantaneous steam-to-oil ratio (iSOR) of about 1 during the performing of the production phase, and the production phase is a solvent-driven process (SDP) production phase.

12. The method of claim 1, wherein the performing of the solvent-recovery phase is preceded by a recovery factor of at least about 50% during the performing of the production phase.

13. The method of claim 1, wherein the performing of the solvent-recovery phase is preceded by a recovery factor of at least about 60% during the performing of the production phase.

14. The method of claim 1, wherein the solvent comprises propane, butane, diluent, natural gas condensate, an alcohol, and amine, or a combination thereof.

15. The method of claim 14, wherein the solvent comprises propane.

16. The method of claim 1, wherein the NCG comprises methane, air, flue gas, $CO_2$, $O_2$, $N_2$, or a combination thereof.

17. The method of claim 16, wherein the NCG comprises methane.

18. The method of claim 1, wherein the subterranean reservoir is a thin pay reservoir having a height of between about 5 m and about 15 m.

* * * * *